US008015636B2

(12) United States Patent
Bolish et al.

(10) Patent No.: US 8,015,636 B2
(45) Date of Patent: Sep. 13, 2011

(54) CORNERLESS SHEETS

(76) Inventors: Robert Bolish, Pembroke Pines, FL (US); Rhoda Sherwin, Pembroke Pines, FL (US)

( * ) Notice: Subject to any disclaimer, the term of this patent is extended or adjusted under 35 U.S.C. 154(b) by 0 days.

(21) Appl. No.: 12/830,511

(22) Filed: Jul. 6, 2010

(65) Prior Publication Data

US 2011/0023234 A1 Feb. 3, 2011

Related U.S. Application Data

(60) Provisional application No. 61/270,146, filed on Jul. 6, 2009.

(51) Int. Cl.
*A47G 9/02* (2006.01)

(52) U.S. Cl. ..... 5/496; 5/497; 5/499

(58) Field of Classification Search ..... 5/494–499
See application file for complete search history.

(56) References Cited

U.S. PATENT DOCUMENTS

| | | | | |
|---|---|---|---|---|
| 2,598,141 | A | 5/1952 | Simpson | |
| 2,605,483 | A | 8/1952 | Ridenhour | |
| 2,757,389 | A * | 8/1956 | King | 5/496 |
| 3,013,283 | A | 12/1961 | Steffinich | |
| 3,083,379 | A * | 4/1963 | Marinsky | 5/496 |
| 3,530,487 | A * | 9/1970 | Beer | 5/496 |
| 3,638,252 | A | 2/1972 | Palenske | |
| 3,832,743 | A | 9/1974 | Smith | |
| 4,045,832 | A | 9/1977 | DiForti et al. | |
| 4,095,300 | A | 6/1978 | Ruben | |
| 4,144,602 | A * | 3/1979 | Fernandes | 5/496 |
| 4,245,365 | A | 1/1981 | Large | |
| 4,344,196 | A * | 8/1982 | Large | 5/496 |
| 4,384,380 | A | 5/1983 | Glaha et al. | |
| 4,461,048 | A * | 7/1984 | Allaire, Jr. | 5/497 |
| 4,651,371 | A * | 3/1987 | Hahn | 5/497 |
| 4,912,790 | A | 4/1990 | Macdonald | |
| 4,964,184 | A | 10/1990 | Lewis | |
| 5,029,353 | A | 7/1991 | Kimball et al. | |
| 5,084,929 | A | 2/1992 | Staudinger | |
| 5,165,128 | A | 11/1992 | Honig | |
| 5,173,976 | A | 12/1992 | Jubinville | |
| 5,729,847 | A | 3/1998 | Allardice | |
| 6,041,456 | A | 3/2000 | Pharr | |
| 6,892,404 | B2 * | 5/2005 | Harbin et al. | 5/497 |
| 6,983,500 | B2 | 1/2006 | Wootten | |
| 7,260,858 | B2 * | 8/2007 | Cushing | 5/497 |
| 7,293,306 | B2 | 11/2007 | Hermanczuk | |
| 7,380,297 | B2 | 6/2008 | Bauer | |
| 2004/0255381 | A1 | 12/2004 | Generalovich, II | |
| 2007/0151028 | A1 | 7/2007 | Bauer | |
| 2009/0044337 | A1 | 2/2009 | McKee | |

FOREIGN PATENT DOCUMENTS

| | | |
|---|---|---|
| GB | 2 292 075 A | 2/1996 |

* cited by examiner

*Primary Examiner* — Michael Trettel
(74) *Attorney, Agent, or Firm* — Gearhart Law, LLC

(57) ABSTRACT

This invention relates to flat bedding top sheets having releasable corner fasteners adapted to releasably secure sheet to an underlying mattress by having male elements placed on one side panel brought into alignment and contact with female elements located on opposite corresponding side panels to form corners. Specifically, the bed sheet of the present invention is a fitted flat sheet having a cutout portions at both of its bottom corners that permit, with the aid of separable fasteners located at the cutout portions, to convert the sheet from a planar configuration to a configuration comprising two pockets adapted to retain the sheet on the mattress. The top sheets of the present invention do not require elastic strips around the corners of the sheets to secure the sheet to the mattress.

8 Claims, 7 Drawing Sheets

Fig. 5
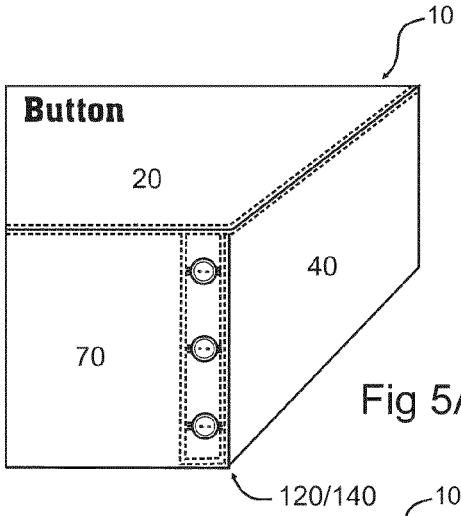
Fig 5A
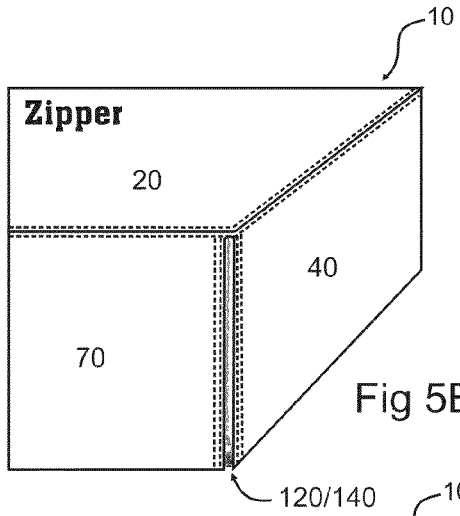
Fig 5B
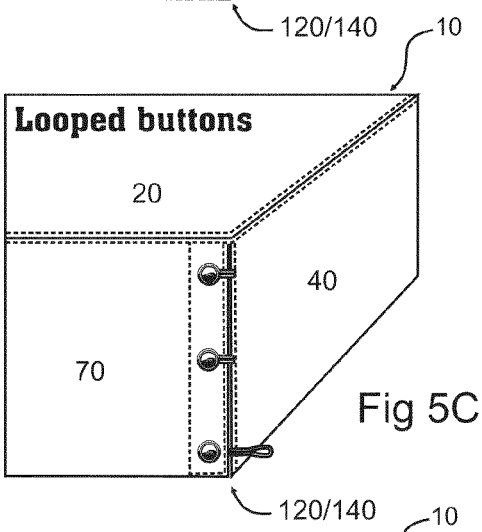
Fig 5C
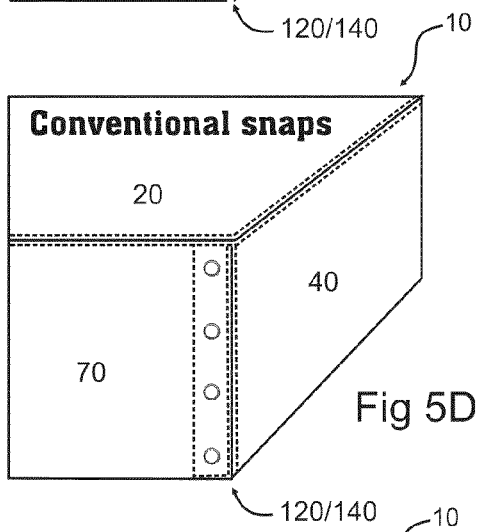
Fig 5D
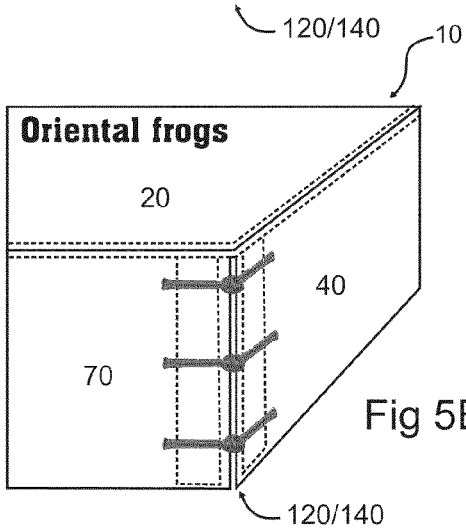
Fig 5E
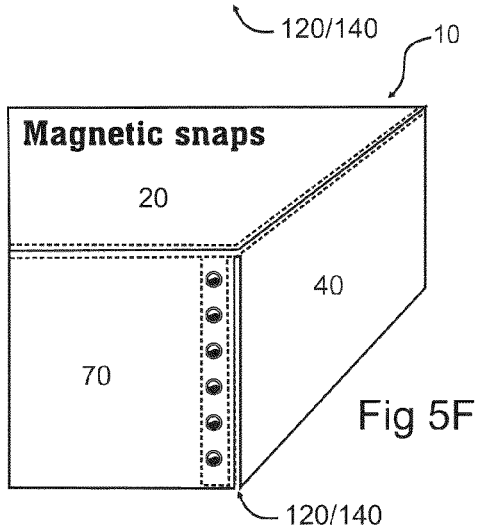
Fig 5F

Fig. 5 (ctd)

CORNERLESS SHEETS

CLAIM OF PRIORITY

The present invention claims the priority of the U.S. Provisional Patent Application 61/270,146, filed on Jul. 6, 2009. The contents of the aforementioned applications are fully incorporated herein by reference.

FIELD OF INVENTION

This invention relates to bedding top sheets, and more particularly, to bedding top sheets having releasable fasteners. One aspect of the invention relates to flat fitted sheets having releasable corner fasteners to create pockets which fit around the corners of a mattress to fit snugly over mattresses of various thicknesses wherein the sheets do not have an elastic strip sewn around the bottom corners of the sheet.

BACKGROUND OF THE INVENTION

Numerous problems have been encountered in both the manufacture and use of conventional fitted sheets. Conventional fitted sheets typically employ various combinations of seams and/or elastic bands at the corners. The contoured corners thus formed are intended to fit snugly over the corners of an underlying mattress whenever the sheet is in use.

Bed linen manufacturers generally produce conventional fitted sheets having a single set of dimensions for each standard bed size, difficulties frequently arise when the sheets are used by the consumer. When the conventional fitted sheets are placed over a relatively thinner or smaller mattress, the corners may not fit snugly, causing the sheet to bunch or wrinkle across the bed surface, making the bed uncomfortable and unattractive. Conventional fitted sheets are used with relatively thicker or larger mattresses, it is often difficult to stretch the last corner over the mattress, and ripping or tearing of the corner construction may occur, particularly after repeated use and laundering. In addition, conventional fitted sheets require the end user to lift at least one corner of the mattress to place the fitted sheet on the mattress.

Contoured or fitted sheets overcome some of the problems associated with flat bedsheets by sewing an elastic strip around the bottom corners of the sheet to create pockets which fit around the four corners of the mattress. The sheet is tucked under the mattress for three corners than on the forth corner, the mattress is lifted up to allow the pocket of the sheet to be slipped over the corner of the mattress. Principle disadvantages of conventional fitted sheets are they often wear out at the pockets, are bulky to store, wash, and handle and that the end user must lift up the mattress to allow the pocket of the sheet to be slipped over the corner of the mattress.

U.S. Pat. No. 5,173,976 to Jubinville discloses a mattress cover/fitted bedding top sheet which consists of a substantially rectangular blank of textile material with opposed sides and opposed ends. A pair of generally triangular pieces are cut out of the opposed sides adjacent the ends. Each of the triangular cut outs has a pair of opposed sides, an apex directed inwardly on the textile material and a base coincident with one of the sides of the textile material. The sides of the triangular cut outs are joined to form a biased side seam such that, when placed on a mattress, textile material is drawn under the end of the mattress.

U.S. Pat. No. 6,983,500 to Wootten discloses a fitted cornerless bedclothing item such as a sheet, mattress pad, anti-allergy cover, blanket or coverlet includes a top portion, side portions and end portions, and elastic segments stitched to edges of respective side and end portions. One or more elastic bindings are provided at lower edges of the side and end portions to cause the tops of the elastic segments to be positioned below the respective upper corners of the mattress on which the bedclothing item is mounted, such that no ears or pockets are formed when the bedclothing item is mounted on mattresses of at least two different sizes and/or thicknesses. The elastic segments are made of knitted or woven elastic filaments, such as SPANDEX® fabric, and can be shaped to have a straight lower edge and a curved upper edge, the curved upper edge advantageously approximating an end of an ellipse.

U.S. Pat. No. 4,245,365 to Large, et al. discloses a fitted top contour sheet having an end pocket receiving the rear of a mattress and pairs of hooks and eyes to secure the bottom of the pocket to the mattress.

U.S. Pat. No. 4,912,790 to Macdonald discloses a fitted bedding top sheet includes a substantially rectangular main body portion of substantially the same dimensions as a selected mattress. Side portions extend from the sides of the main body portion and terminate in longitudinal edges. End portions extend from the ends of the main body portion and terminate in end edges. Substantially vertical corner seams join the side portions to the adjacent end portions, each seam extending from an inner end at a corner of said main body portion to an outer end at the junction of a longitudinal edge and an end edge. The side edges and end edges are thereby joined together to define a perimeter. There is elastic in at least a portion of the perimeter, to permit the sheet to fit snuggly around a mattress. Macdonald discloses that the vertical corner seams are at least partly elasticized.

U.S. Pat. No. 5,165,128 to Honig discloses a fitted bedding top sheet of a generally rectangular blank of fabric material having two bottom corners, each corner cut away by three curved lines to form a junction having an angle of substantially 90 degrees, to each of which a band of stretchable material is sewn, in stretched condition, to the outside edge of the cut corners and along the entire edge portion of the bottom of the blank, which cut corners are then joined by stitching at each corner and bottom edges thereof, thereby forming two expandable pockets for engaging the bottom corners and bottom portion of a mattress.

Other patents disclosing fitted bedding top sheets, or variations thereof, include U.S. Pat. No. 2,598,141 to Simpson, U.S. Pat. No. 2,605,483 to Ridenhour, U.S. Pat. No. 3,013,283 to Steffinich, U.S. Pat. No. 3,638,252 to Palenske, U.S. Pat. No. 3,832,743 to Smith, U.S. Pat. No. 4,045,832 to DiForti, U.S. Pat. No. 4,095,300 to Ruben, U.S. Pat. No. 4,384,380 to Glaha, et al., U.S. Pat. No. 4,964,184 to Lewis, U.S. Pat. No. 5,029,353 to Kimball et al., U.S. Pat. No. 5,084,929 to Staudinger, U.S. Pat. No. 5,729,847 to Allardice, U.S. Pat. No. 6,041,456 to Pharr, U.S. Pat. No. 7,293,306 to Hermanczuk, U.S. Pat. No. 7,380,297 to Bauer, U.S. Patent Publication No. 2004/00255381 to Generalovich II, U.S. Patent Publication No. 2007/0151028 to Bauer, U.S. Patent Publication No. 2009/0044337 to McKee, and non-US Patent document GB2292075A to Wong.

The use of stitched darts and/or elastic to form the fitted corners as disclosed in the foregoing patents requires the use of manufacturing procedures that are more complicated and expensive than would be needed if such stitching were not required. Furthermore, sheets made in such manner cannot be laid out flat, and are therefore more difficult to fold, package and store.

The use of VELCRO fasteners(hook and loop fastners) with sheets is also disclosed in U.S. Pat. Nos. 3,832,743 and 4,241,466. These patents disclose the use of releasable fasteners for separably fastening one edge of a bedding top sheet to a side or end panel of an underlying bottom sheet to prevent the bedding top sheet from coming loose or untucked during use.

SUMMARY OF THE INVENTION

An object of the present invention is to provide a bed sheet comprising a flat one piece top sheet having a top panel, at least three side panels, and at least three bottom panels; the flat one piece top sheet having the two portions removed to eliminates the extra overage at the corner of the bed; a male element of a releasable corner fastener being placed on the edge of at least one side panel; a female element of a releasable corner fastener being placed on the edge of at least one side panel; the male element and female element forming a corner when the male element is placed on the edge of side panel which corresponds to the female element placed on a corresponding edge of a side panel are joined together; the at least three bottom panels having 90 degree edges.

According to the present invention, bedding top sheets are provided that are adapted by means of adjustable, releasable fasteners to be quickly installed over or removed from mattresses without requiring the end user to lift up the mattress to allow the corners of the sheet to be placed over the mattress. The bedding top sheets of the invention are designed and constructed so as to be easily manufactured, folded and stored.

According to one embodiment of the invention, a fitted flat sheet is provided having releasable corner fasteners which do not have an elastic strip sewn around the bottom corners of the sheet.

According to another embodiment of the invention, a fitted sheet is provided that comprises corners formed by releasable corner fasteners placed on corresponding side and bottom panels of the sheet.

According to a preferred embodiment of the present invention, the releasable corner fasteners have a male element and a corresponding female element.

This invention relates to a fitted bedding top sheet that has cut out bottom portions each of which portions are oriented at 90 degree angles to be folded about the bottom corners of a mattress wherein the corners are formed by male elements of the releasable corner fastener placed on one side panel being in contact with female elements placed on an opposite corresponding side panel.

It is an object of the present invention to provide for an improved fitted sheet.

Another object is to provide for such a sheet which has bottom corner cutout portion with a male element of a releasable corner fastener place on one side panel which is aligned and connected with a female element of a releasable corner fastener placed on the corresponding opposite side panel permitting a sheet to be firmly secured to a corner of the mattress, whereby the sheet can be converted from a first planar configuration to a second, pocketed configuration.

It is another object of the present invention to provide for an improved fitted sheet which can be easily and quickly secured to a corner of the mattress.

It is another object of the present invention to provide for an improved fitted sheet which will be firmly secured to a corner of the mattress so it will not become dislodged during use.

The present invention is a sheet construction that engages a mattress securely around the corners of a mattress without requiring elastic strips at the corners of the mattress. The sheet construction includes a main panel having mattress-encompassing side and bottom panels at corresponding ends. Corners are formed by two cooperating side panels that overlap and are detachably secured together via releaseable corner fasteners having corresponding male and female elements.

It is an object of the present invention that the sheets have releaseable corner fasteners that include, but are not limited to, buttons, snaps, zippers, hook and loop fastener (VELCRO), hooks, magnetic snaps and oriental frogs, all having corresponding male and female elements.

A further objective is to provide a sheet which is easy to wash, store, and handle.

It is another object of the present invention to provide bedding top sheets which facilitate the covering of a mattress without the use of "Hospital style corners" or "Military style corners".

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 5A is a side view of one of the bottom corners of the sheet after it is folded about a mattress showing corresponding side panels secured by a releasable fastener in the form of a button.

FIG. 5B is a side view of one of the bottom corners of the sheet after it is folded about a mattress showing corresponding side panels secured by a releasable fastener in the form of a zipper.

FIG. 5C is a side view of one of the bottom corners of the sheet after it is folded about a mattress showing corresponding side panels secured by a releasable fastener in the form of a looped button.

FIG. 5D is a side view of one of the bottom corners of the sheet after it is folded about a mattress showing corresponding side panels secured by a releasable fastener in the form of conventional snaps.

FIG. 5E is a side view of one of the bottom corners of the sheet after it is folded about a mattress showing corresponding side panels secured by a releasable fastener in the form of oriental frogs.

FIG. 5F is a side view of one of the bottom corners of the sheet after it is folded about a mattress showing corresponding side panels secured by a releasable fastener in the form of a magnetic snaps.

Like numbers are used to designate like parts in all figures of the drawings. In FIGS. 1-4, the length direction of the sheet is designated with an arrow identified by the letter L and the width direction of the sheet is designated with an arrow identified by the letter W. The dashed lines shown in FIGS. 1-4 are fold lines showing where the sheets of the invention would drape over the edges of an underlying mattress (not shown). In each of FIGS. 1-4, the length and width of the subject sheets as measured between the fold lines at the four corners should generally correspond to the dimensions of the top surface of the standard mattress size with which the sheet is to be used. The distance between the fold lines and the respective edges of the sheet should generally correspond to the thickness dimension of the mattress with which the sheet is to be used.

DESCRIPTION OF THE PREFERRED EMBODIMENT

The invention is further described and explained in relation to FIGS. 1-6 below. For the fitted sheets of the present invention, the releasable corner fasteners of the invention are desirably utilized on at least two corners, preferably the two bottom corners. It is desired to make a bedding top sheet that will remain untucked at the head of a bed but will fasten snugly over the bottom sheet and mattress at the foot of a bed, the releasable corner fasteners of the invention are desirably used on only the bottom corners.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

For purposes of the present invention, the bed sheets disclosed herein are understood to be manufactured primarily from textile materials. The fitted bedding top sheet of the present invention may be formed of any conventional sheet fabric, woven or knitted. The sheets of the present invention made be constructed of cotton, polyester, linen, rayon, or a blend thereof.

The bedding top sheet of the present invention pertains to all top sheets, including but not limited to blankets, coverlets, quilts, duvets, mattress pads, bed spreads and comforters.

The bedding top sheets of the present invention facilitate the covering of a mattress without the use of "Hospital style corners" or "Military style corners".

Figure 1:
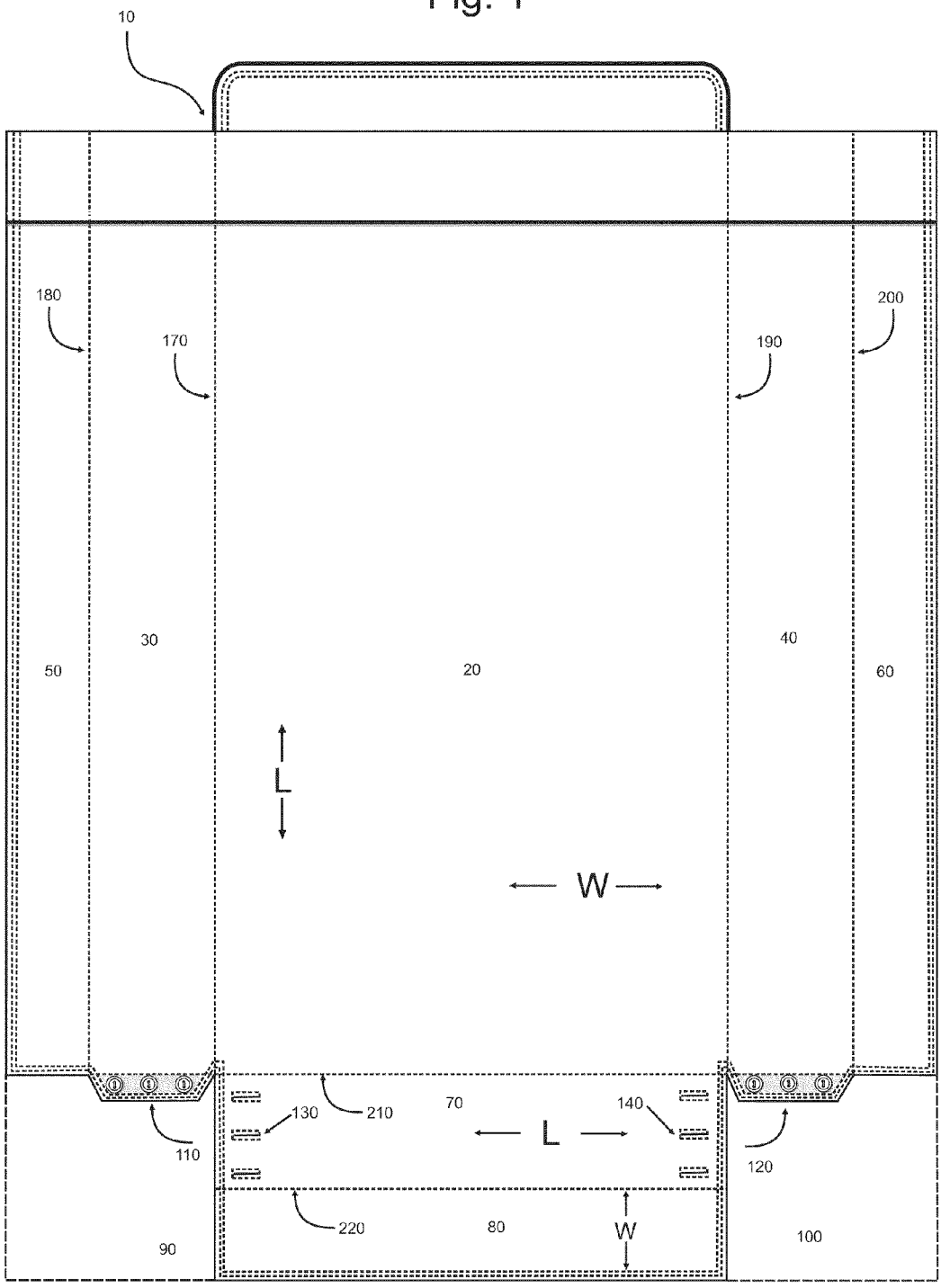
FIG. 1 is a top view of one embodiment of a bed sheet of the present invention having releasable corner fasteners in a flat position before it is folded about a mattress having 90 degree angles along the edges of the bottom panels of the sheet.
Figure 2:
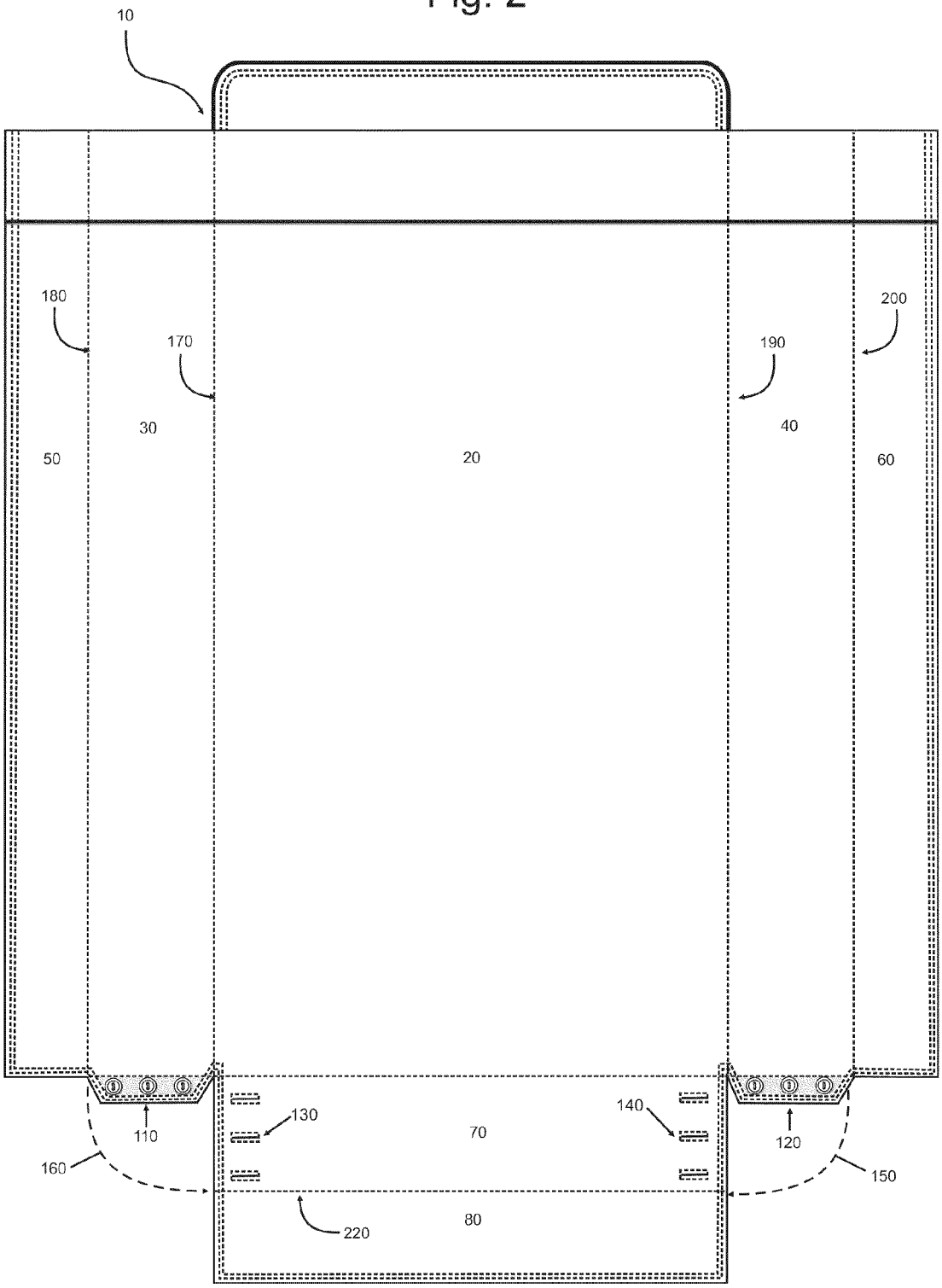
FIG. 2 is a top view of an embodiment of a bed sheet as depicted in FIG. 1 showing the direction in which the corresponding side panels will be folded to form a corner around the a mattress.

As depicted in FIGS. 1 and 2, one embodiment of the bed sheet 10 of the present invention provides a flat one piece top sheet appears as two intersecting rectangular shapes comprising top panel 20, side panels (30, 40, 70), bottom panels (50, 60, 80), where sections 90 and 100 are eliminated to eliminates the extra overage at the corner of the bed, giving it much neater lines and reduces chances of tripping when walking around the bed. As depicted in FIG. 1, a male element 110 of a releasable corner fastener is placed on the edge of side panel 30 which corresponds to female element 130 of a releasable corner fastener placed on the edge of side panel 70 which form a corner when male element 110 is joined to corresponding female element 130. Similarly, as depicted in FIG. 1, a male element 120 of a releasable corner fastener is placed on the edge of side panel 40 which corresponds to female element 140 of a releasable corner fastener placed on the edge of side panel 70 which form a corner when male element 120 is joined to corresponding female element 140. As seen in FIGS. 1 and 2, bottom panels 50, 60 and 80 have 90 degree edges.

Male elements (110,120) and female elements (130, 140) of a releasable corner fastener may be of various types including, but not limited to, buttons, snaps, zippers, Velcro, hooks, magnetic snaps, and oriental frogs.

The bottom panels of the bed sheets (50, 60, 80) extend past the depth of the mattress and may be either tucked in or left out to hang loosely like a bed skirt if desired.

Figure 3:
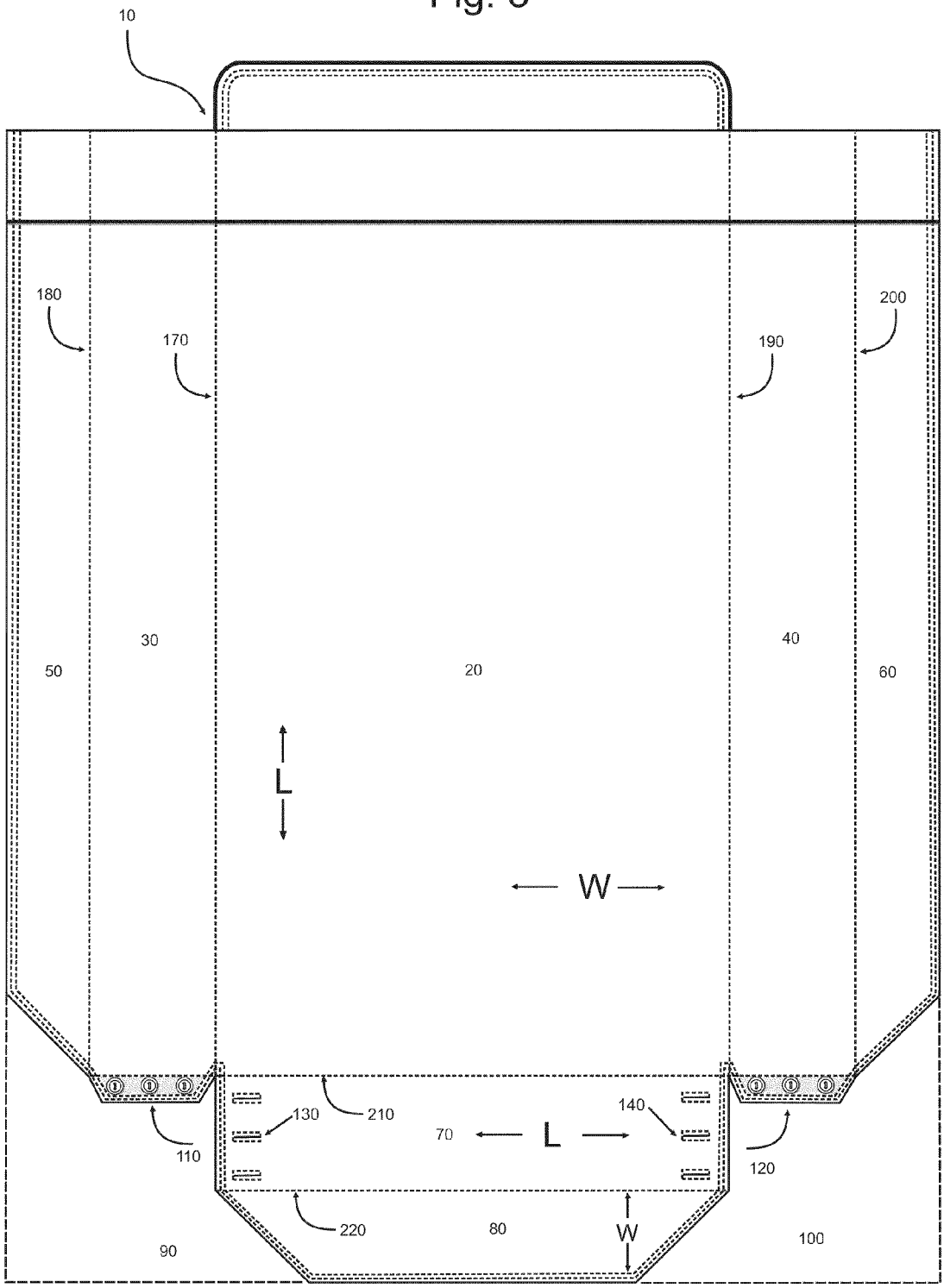
FIG. 3 is a top view of one embodiment of a bed sheet of the present invention in a flat position before it is folded about a mattress having 45 degree angles along the edges of the bottom panels of the sheet.
Figure 4:
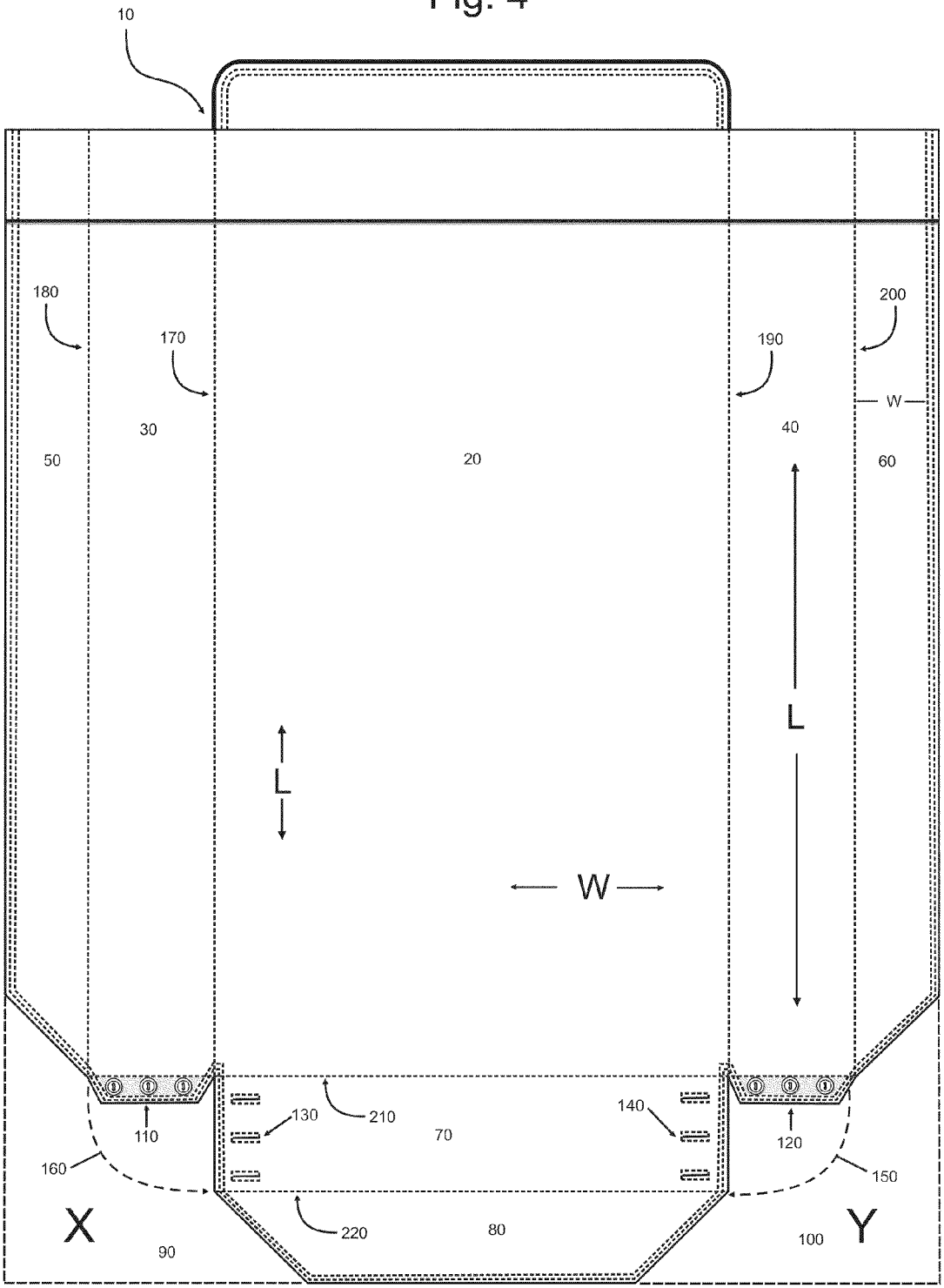
FIG. 4 is a top view of an embodiment of a bed sheet as depicted in FIG. 3 showing the direction in which the corresponding side panels will be folded to form a corner around the a mattress.
Figure 5G:
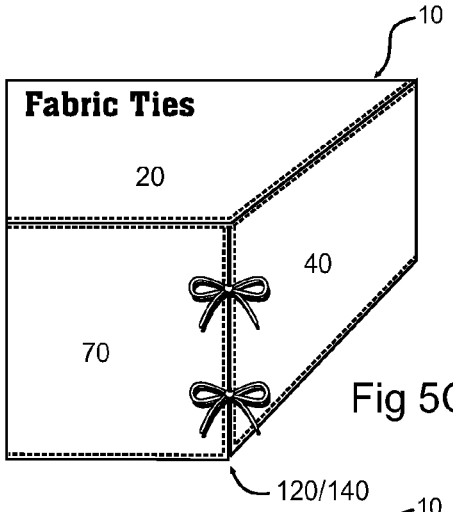
FIG. 5G is a side view of one of the bottom corners of the sheet after it is folded about a mattress showing corresponding side panels secured by a releasable fastener in the form of a fabric ties.
Figure 5H:
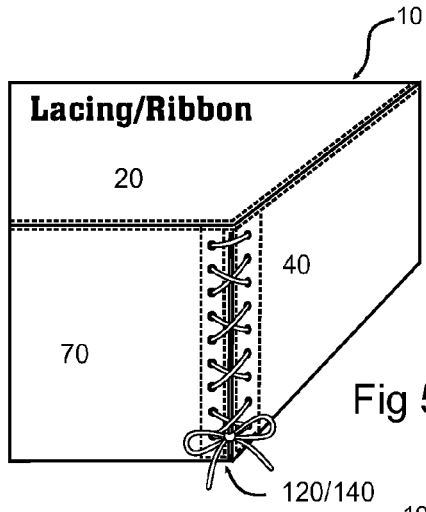
FIG. 5H is a side view of one of the bottom corners of the sheet after it is folded about a mattress showing corresponding side panels secured by a releasable fastener in the form of a lacing/ribbon.
Figure 5I:
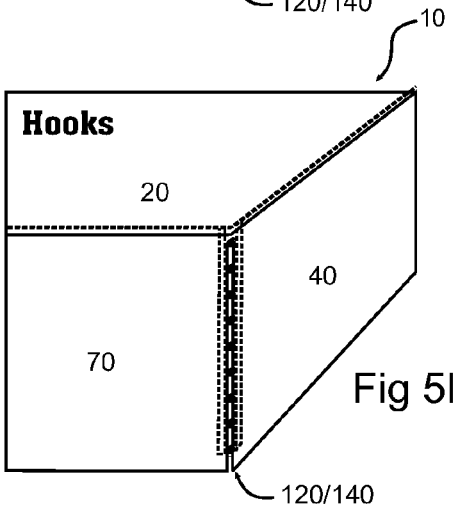
FIG. 5I is a side view of one of the bottom corners of the sheet after it is folded about a mattress showing corresponding side panels secured by a releasable fastener in the form of hooks.
Figure 5J:
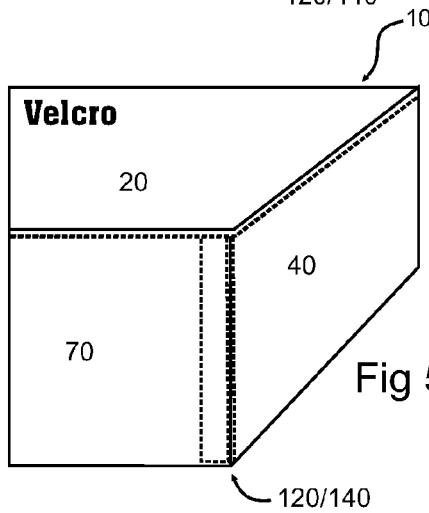
FIG. 5J is a side view of one of the bottom corners of the sheet after it is folded about a mattress showing corresponding side panels secured by a releasable fastener in the form of a velcro.
Figure 6:
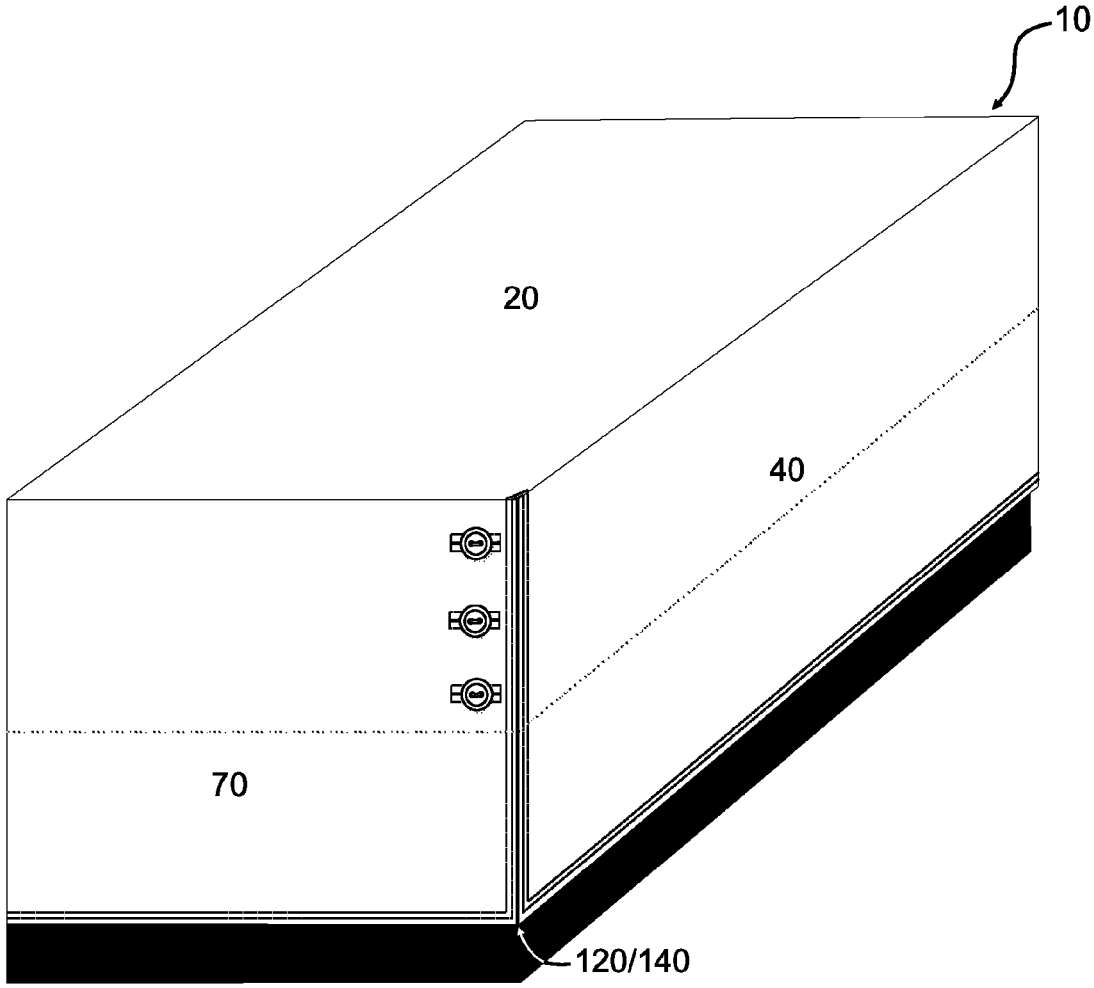
FIG. 6 is a side view of one of the bottom corners of the sheet after it is folded about a mattress showing corresponding side panels secured by a releasable fastener in the form of a button with an untucked bottom panel.

As depicted in FIGS. 3 and 4, another embodiment of the bed sheet 10 of the present invention provides a flat one piece sheet appears as two intersecting rectangular shapes comprising side panels (30, 40, 70), bottom panels (50, 60, 80), where sections 90 and 100 are eliminated to eliminates the extra overage at the corner of the bed, giving it much neater lines and reduces chances of tripping when walking around the bed. As depicted in FIG. 1, a male element 110 of a releasable corner fastener is placed on the edge of side panel 30 which corresponds to female element 130 of a releasable corner fastener placed on the edge of side panel 70 which form a corner when male element 110 is joined to corresponding female element 130. Similarly, as depicted in FIG. 1, a male element 120 of a releasable corner fastener is placed on the edge of side panel 40 which corresponds to female element 140 of a releasable corner fastener placed on the edge of side panel 70 which form a corner when male element 120 is joined to corresponding female element 140. As seen in FIGS. 1 and 2, bottom panels 50, 60 and 80 have 45 degree edges. As seen in FIGS. 3 and 4, the flat one piece sheet is cut on a 45 degree angles bilaterally on the sides and foot of the bed to reduce overlapping and bunching making it easier to make a bed. The top flat sheet appears as two intersecting rectangular shapes but angled 45 at the foot/side of the bed to reduce over lapping or bunching.

Male elements (110,120) and female elements (130, 140) of a releasable corner fastener may be of various types including, but not limited to, buttons, snaps, zippers, hoop and loop fastener (VELCRO), hooks, magnetic snaps, and oriental frogs.

The bottom panels of the bed sheets (50, 60, 80) extend past the depth of the mattress and may be either tucked in or left out to hang loosely like a bed skirt if desired.

The sheet 10 of the present invention has a top panel 20 and bottom panels 50, 60, and 80 with side panels 30, 40, and 70 extending between the top and the bottom of the sheet. Each sheet has a bottom panels 50, 60, and 80 which will allow the sheet to be tucked under a mattress. At each of the bottom corners of the sheet 10, cutout portions 90, 100 are provided.

Side panels 30, 70 have complimentary fasteners 110, 130 disposed therealong. When the side panels 30, 70 are folded about the corner of the mattress, the fasteners 110, 130 will be secured together in order for the sheet to be secured to the mattress. It should be noted that while the fasteners 110, 130 are shown as buttons, any conventional fastener such as, but not limited to, hook and loop fasteners, snap fasteners, zipper hook and loop fastener (VELCRO), magnetic snaps, oriental frogs could be used, as long as the fastener will securely hold the bottom portion of the sheet onto the bottom of the mattress. In addition, the number of fasteners on the side panels is not material. For example, three fasteners are shown in FIG. 1-4 and five fasteners are shown in FIGS. 5D and 5F.

Side panels 40, 70 have complimentary fasteners 120, 140 disposed therealong. When the side panels 40, 70 are folded about the corner of the mattress, the fasteners 120, 140 will be secured together in order for the sheet to be secured to the mattress. It should be noted that while the fasteners 120, 140 are shown as buttons, any conventional fastener such as, but not limited to, hook and loop fasteners, snap fasteners, zipper, magnetic snaps, oriental frogs could be used, as long as the fastener will securely hold the bottom portion of the sheet onto the bottom of the mattress. In addition, the number of fasteners on the side panels is not material. For example, three fasteners are shown in FIG. 1-4 and five fasteners are shown in FIGS. 5D and 5F.

FIGS. 5A to 5J and FIG. 6 shows the sheet in its final folded position about the corner of the mattress. In FIGS. 5A to 5J, bottom panels 50, 60, 80 (not shown)have been folded under the mattress and extends between the mattress and the box spring. Panels 20, 40 and 70 have been folded onto the side of the mattress and the male elements of the releasable fasteners 110, (not shown) 120 have been engaged with the female elements of the releasable fasteners 130, (not shown) 140 thereby forming two pockets that retain the sheet on the mattress.

Bottom panels 50, 60 and 80 may remain untucked if desired by the end user.

In use, an end user would first place top panel 20 on the top side of a mattress. Panels 30, 40 and 70 would be folded down along the side of the mattress along fold lines 170, 190 and 210 as depicted in FIG. 1. Next, male elements of the releasable fasteners 110, 120 will be engaged with the female elements of the releasable fasteners 130, 140 thereby forming two pockets that retain the sheet on the mattress. Then the bottom panels 50, 60 and 80 would be folded under the mattress if desired. This same procedure would be performed on the opposite bottom corner and this would quickly and easily secure the bottom of the sheet to the bottom of the mattress. It is contemplated that bottom panels 50, 60 and 80 may remain untucked if desired by the end user.

FIGS. 5A to 5J relate to an embodiment of the invention employing various releasable corner fasteners. In FIG. 1-4, sheet 10 is shown in a flat position, as if extended outwardly past the top surface of an underlying mattress. Releasable fastener 110/130 and 120/140 are disposed perpendicularly to each other and in general alignment with fold lines 170, 190 and 210 as indicated by arrows 150 and 160 in FIGS. 2 and 4 respectively. Releasable fastener 110 is secured to side panel 30 and releasable fastener 130 is secured to side panel 70 located toward the foot of sheet 10. Male elements of the releasable fasteners (110, 120) which will be engaged with the female elements of the releasable fasteners (130, 140) are preferably made of hook and loop fasteners, buttons, snaps, zippers, hooks, magnetic snaps, oriental frogs or some other similar releasable fastening material.

Referring to FIG. 1, side panels 30, 40 and 70 of sheet 10 are draped downwardly from fold lines 170, 190 and 210 causing male elements of the releasable fasteners (110, 120) and female elements of the releasable fasteners (130, 140) to be brought into facing and contacting alignment with each other.

Referring to FIG. 1, sheet 10 is shown in a substantially flat position, as if extended outwardly past the top surface of an underlying mattress. Bottom panels 50, 60 and 80 are defined by fold lines 180, 200 and 220. Bottom panels 50, 60 and 80 may be tucked under a mattress along fold lines 180, 200 and 220. In the alternative, the end user may choose to have bottom panels 50, 60 and/or 80 untucked.

Referring to FIG. 5A-5J, the corner of sheet 10 is fully formed and secured by male elements of the releasable fasteners (110, 120) located on side panels 30 and 40 respectively and female elements of the releasable fasteners (130, 140) located on side panel 70 brought into facing and contacting alignment with each other.

Releasable corner fasteners 110/130 and 120/140 are adapted to removably connect side panel 30 to side panel 70, as well as, side panel 40 to side panel 70 together to maintain the side panels in substantially fixed relationship to each other, whereby the sheet of material follows the natural contour of the mattress.

Releasable corner fasteners 110/130 and 120/140 may be hook and loop type material, such as that available under the trademark VELCRO, as well as, any other fasteners, including but not limited to buttons, conventional snaps, looped buttons, oriental frogs, magnetic snaps, fabric ties, or zippers.

With additional reference to FIG. 1, the top panel 20 is substantially-rectangular piece of fabric sized to fit a desired size of mattress, e.g. twin, full, queen, king or emperor.

The bedding top sheets of the present invention come in lengths and widths that are fairly standard including, but not limited to, twin, full, queen, king, or emperor size.

Female elements of the fastener (130, 140) are provided to extend in a transverse direction with respect to male elements of the fastener (110,150).

The female elements of the fastener (130, 140) may be detached from male elements of the fastener (110,150) to allow the sheet 10 to become loose and unfolded and to allow for easy removal from the mattress.

FIG. 1 illustrates the sheet 10 having a central rectangular top panel 20 of a size to cover the top of the mattress. Side panels 30, 40 and 70 are of sufficient length and width to cover the sides of the mattress. The edges of side panels 30, 40 and 70 are locked at each corner by the several methods illustrated in FIGS. 5A to 5J. When the sheet 10 is placed on a mattress the top portion 20 will lie smoothly without wrinkling. The end portions of panels 30, 40 and 70 will fit smoothly around the corner of the mattress and can be locked to each other by a fastening mechanism, including but not limited to, buttons, zipper, looped buttons, conventional snaps, oriental frogs, magnetic snaps, fabric ties, lacing/ribbons, hooks, and hook and loop fastener, as illustrated in FIGS. 5A to 5J.

The sheet is removed by detaching the female elements of the fastener (130, 140) from male elements of the fastener (110,150). The sheet can be laundered and ironed. The sheet of the present invention is easy to lock into position and to remove.

Panels 30 and 70 can be locked to each other at the corner. Similarly, panels 40 and 70 can be locked to each other at the corner. The locking mechanism can be used at either or both corners.

Since the sheet is usually folded back at the head end of the bed, in a preferred embodiment, the releasable corner fasteners need only be secured to the two corners at the foot of the bed.

The sheet of the present invention comprises a generally rectangular flat piece of woven material wherein a portion of material 90 and 100 has been removed from each corner located at the end portion of the sheet to form a 90 degree angle.

FIGS. 5A to 5J are side views of one corner of the flat sheet showing the association of the releasable fastening means for retaining the flat sheet about the mattress.

The flat sheet of the invention comprises a generally flat quadrilateral panel of fabric, preferably woven, having a main or central area designated generally by the numeral 20 and defined at opposite ends by the fold lines 170, 190 and 210 which may be taken to be fold lines. On the lateral sides, the main area is defined by fodl lines 180, 200 and 220 which define the side panel 30, 40, and 70, as well as, bottom panels 50, 60 and 80. The size of the mattress may be any of the known standard sizes, including but not limited to, twin size, queen size, and king size.

As illustrated in FIG. 1, the flat sheet of the present invention is formed from a generally rectangular panel, the lower left and right corners of the bottom end of the sheet being cut at 90 degree angles as seen in FIG. 1. As indicated by broken lines, generally quadrilateral portions 90 and 100 are cut away at each corner so as to leave the end and side panels extending from the main area of the sheet, side panels being designated by the numerals 30, 40 and 70 and bottom panels being designated by the numeral 50, 60 and 80.

As seen in FIG. 3, another embodiment of the present invention comprises each outside corner of bottom panel having a triangular portion removed to result in a panels 50, 60 and 80 having 45 degree edges.

As seen in FIG. 1-4, it will be noted that broken lines 170, 180, 190, 200, 210 and 220 have been illustrated in side and bottom panels 30, 40, 50, 60, 70 and 80. These broken lines represent fold lines and are illustrated in drawing for purposes of illustration only and do not appear in the finished product. They are included herein to illustrate the top, side and bottom panels that lies between the broken lines and defining the main area and the fold lines of the side panels are equivalent to the thickness dimension of the mattress, while the fold lines of the bottom panel constitutes that portion of the bottom panel that is tucked under the mattress.

The thickness or height of the mattress is encompassed by that portion of the side panel lying between the fold lines 170 and 180, 190 and 200, as well as 210 and 220 respectively It is therefore apparent upon reading this disclosure in view of the accompanying drawings that the bedding top sheets disclosed herein offer significant advantages that have not previously been disclosed or appreciated. Other alterations and modifications of the invention may become apparent upon reviewing this disclosure, and it is intended to cover all such alterations and modifications as fall within the scope of the appended claim.

What is claimed is:

1. A bed sheet comprising:

a flat one piece top sheet having a substantially rectangular top panel, at least three substantially rectangular side panels, and at least three substantially rectangular bottom panels;

the side panels having a length substantially equal to the length or width of an edge of the top panel to which they are attached, and the bottom panels having a length equal to the length of the side panels to which they are attached, thereby eliminating extra overage at the corner of the bed;

a male element of a releasable corner fastener being placed on the edge of at least one side panel;

a female element of a releasable corner fastener being placed on the edge of at least one side panel; wherein the male element and female element form a corner when the male element and female element of adjacent side panels are joined together.

2. The bed sheet of claim 1 wherein the male element and female element of a releasable corner fastener is a button.

3. The bed sheet of claim 1 wherein the male element and female element of a releasable corner fastener is a snap.

4. The bed sheet of claim 1 wherein the ale element and female element of a releasable corner fastener is a zipper.

5. The bed sheet of claim 1 wherein the male element and female element of a releasable corner fastener is hoop and loop fastener.

6. The bed sheet of claim 1 wherein the male element and female element of a releasable corner fastener is a hook.

7. The bed sheet of claim 1 wherein the male element and female element of a releasable corner fastener is a magnetic snap.

8. The bed sheet of claim 1 wherein the male element and female element of a releasable corner fastener is an oriental frog.

* * * * *